United States Patent [19]

Mursula

[11] 3,947,997

[45] Apr. 6, 1976

[54] COUPLED WINDOW WITH TWO CASINGS AND THREE PANES

[76] Inventor: Arvo Mursula, Alavus, Finland

[22] Filed: May 1, 1975

[21] Appl. No.: 573,407

[30] Foreign Application Priority Data

May 28, 1974 Finland ..... 1634/74

[52] U.S. Cl. ..... 49/62

[51] Int. Cl.[2] ..... E05C 7/02

[58] Field of Search ..... 49/163, 168, 62, 63, 65, 49/67

[56] References Cited

UNITED STATES PATENTS 2,286,899 6/1942 Crescentini ..... 49/67 X

FOREIGN PATENTS OR APPLICATIONS 294,973 2/1954 Switzerland ..... 49/62

1,270,260 4/1972 United Kingdom ..... 49/163

*Primary Examiner*—Kenneth Downey

*Attorney, Agent, or Firm*—Biebel, French & Nauman

[57] ABSTRACT

The invention relates to a coupled window having two casings hinged to each other and an intermediate pane located between said casings. The intermediate pane is at one edge thereof secured to hinge flaps carried on the same hinge pins as the hinges connecting the casings to each other, and at the opposite edge the intermediate pane is provided with one single switch coupling co-operating with counterplates in the inner and outer casings, respectively, in such a manner that the intermediate pane may be alternatively coupled to the inner casing or to the outer casing or to both casings.

2 Claims, 2 Drawing Figures

COUPLED WINDOW WITH TWO CASINGS AND THREE PANES

BACKGROUND OF THE INVENTION

1. Field of the Invention

The present invention relates to a coupled window with two casings and three panes, wherein an intermediate pane provided with a gasket strip is located between the inner and outer casings which are hinged to each other by hinges, and wherein the casings are coupled to each other by means of a switch coupling.

2. Description of the Prior Art

In some previously known three-pane windows with an intermediate pane provided with a gasket strip, the intermediate pane has been coupled to the casings with two or more switches, without hinging. Such an arrangement has, however, caused confusion and disturbance because the coupling members can accidentally be coupled in a different manner with the result that the panes are broken.

In other known three-pane windows with an intermediate pane with a sealing frame, the intermediate pane must be detached for washing, which has proven inconvenient in the case of large windows.

SUMMARY OF THE INVENTION

The object of the present invention is to provide a structure, more reliable in operation than the previously known ones, for double-casing, three-pane windows with an intermediate pane provided with a sealing frame, and the invention is characterized in that one edge of the intermediate pane is attached to hinge flaps carried on the same hinge pins as the hinges supporting the casings, and its opposite edge is provided with one single switch having coupling tongues co-operating with counterplates in the casings, the coupling tongues and the openings of the respective counterplates being shaped and fitted so that in one position of the coupling tongues the intermediate pane is coupled to the outer casing, in the opposite extreme position to the inner casing, and in an intermediate position to both casings. Preferably the switch is provided in addition to the coupling tongues with centering pins co-operating with corresponding openings in said counterplates. These centering pins guide the coupling tongues to the corresponding openings of the counterplates, and on the other hand they support the intermediate pane preventing it from sliding down.

In a window according to the invention, each side of the panes can be easily washed without any risk of breaking the intermediate pane. During the washing the intermediate pane, supported by the hinges, is alternately coupled to the outer casing and the inner casing, respectively.

BRIEF DESCRIPTION OF THE DRAWING

The invention is described below in more detail with reference to the accompanying drawing showing an embodiment of a window according to the invention In the drawing.

DESCRIPTION OF THE PREFERRED EMBODIMENT

Figure 1:
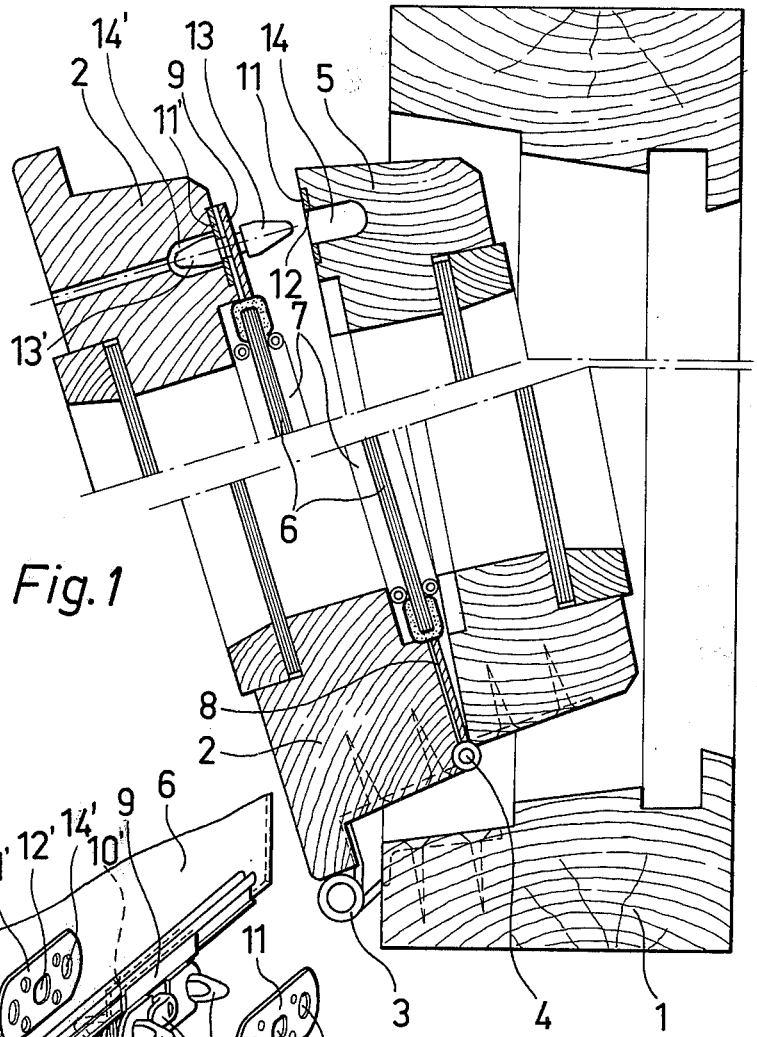
FIG. 1 shows a horizontal cross section of the window and its frame and FIG. 2 shows an exploded view of the switch coupling in the intermediate pane and the corresponding counterplates secured to the inner casing and outer casing, respectively, the casings being not shown for the sake of clarity.

In FIG. 1, number 1 refers to the window frame, 2 is the inner casing which is attached to the frame by hinges 3 and to which the outer casing 5 is attached by hinges 4. The casings 2, 5 can be locked to the frame 1 in any suitable conventional manner, not shown in the drawing. The intermediate pane 6 is located in a recess formed in the outer and inner casings 2, respectively. The intermediate pane is provided with a gasket strip 7 extending along the entire circumference thereof. At one of its edges the intermediate pane is attached to hinge flaps 8 carried on the hinge pins of the hinges 4. A single switch, shown in more detail in FIG. 2, is attached to the opposite edge of the intermediate pane 6.

Figure 2:
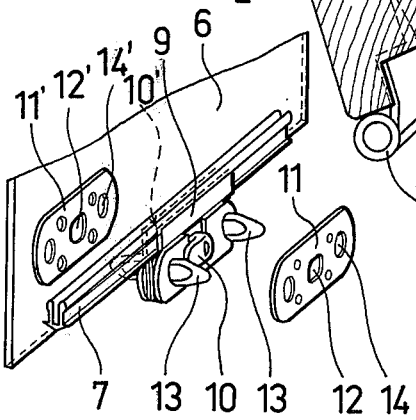

FIG. 2 shows the intermediate pane 6 with part of its gasket strip 7. A coupling plate 9 is attached to the pane and gasket strip. Coupling plate 9 is provided with coupling tongues 10, 10' placed on opposite sides of coupling plate 9 and turnable together. Only one of the coupling tongues 10 is seen in the drawing, the other one being indicated by reference number 10' only. Coupling tongues 10, 10' are turnable by means of a loose handle which can be inserted through a hole (not shown) in the inner or outer casing. A counterplate 11 having an opening 12 corresponding to the shape of coupling tongue 10 is secured to the inner casing 2 (not shown), and an identical counterplate 11' is secured to the outer casing 5 (not shown). Counterplates 11 and 11' are secured to the casings turned in opposite positions so that when coupling tongue 10 is in the end position shown in the drawing, coupling tongue 10' can pass through the corresponding opening 12' in the counterplate 11' secured to the outer casing 5 whereas coupling tongue 10 is locked to its counterplate 11 in the inner casing 2. The outer casing 5 may then be opened, the intermediate pane 6, 7 being coupled to the inner casing 2. Upon turning of coupling tongues 10, 10' 180° from the position shown, the situation is the contrary and upon turning of the coupling tongues 10, 10' to an intermediate position, for example 90°, from the position shown, each coupling tongue 10 and 10' is locked to its corresponding counterplate 11 and 11', respectively, and the inner casing 2, the outer casing 5 and the intermediate pane 6, 7 are coupled to each other forming a three-pane element.

In the embodiment shown, coupling plate 9 is also provided with two centering pins 13, 13' on both sides and the counterplates 11, 11' are provided with corresponding openings 14, 14' for receiving the centering pins. When the casings are coupled to each other, centering pins 13, 13' fit into openings 14, 14' and guide coupling tongues 10, 10' exactly to openings 12, 12' in the counterplates. At the same time centering pins 13, 13' support the intermediate pane 6, 7 so that it cannot slide down.

In large windows in particular, the casings can be coupled to each other not only with the switch coupling illustrated but also with conventional coupling screws, which must be unscrewed before the casings can be detached from each other.

Even though the invention is described above applied to an inwardly opened and side-hinged window, it can as well be applied to windows pivoted on either a vertical or a horisontal axle.

What is claimed is:

1. A window having two single-pane casings connected to each other by hinges and an intermediate pane having a gasket strip encircling the circumference thereof located between said casings, said intermediate pane being at one edge thereof secured to hinge flaps carried on the hinge pins of said hinges connecting said casings to each other, and said intermediate pane being provided at the opposite edge thereof with one single switch coupling having together turnable coupling tongues, each coupling tongue co-operating with a corresponding opening in a counterplate in said inner and outer casings, respectively, said coupling tongues and openings being shaped and arranged such that in one end position of said coupling tongues said intermediate pane is coupled to said inner casing, in an opposite end position of said coupling tongues said intermediate pane is coupled to said outer casing, and in an intermediate position of said coupling tongues said intermediate pane is coupled simultaneously to both said casings.

2. A window as in claim 1, further comprising centering pins in said switch coupling co-operating with corresponding openings in said counterplates in said inner and outer casings, respectively.

* * * * *